US009839337B2

(12) United States Patent
Rauwald

(10) Patent No.: US 9,839,337 B2
(45) Date of Patent: Dec. 12, 2017

(54) ABRASIVE OR CLEANING PAD WITH A COMPOSITE RESIN AS A WEAR LAYER, FLOOR CLEANING SYSTEM AND METHOD OF CLEANING A FLOOR SURFACE

(75) Inventor: Wolfgang Rauwald, Frankfurt (DE)

(73) Assignee: Charlott Produkte Dr. Rauwald GmbH, Noerten-Hardenberg (DE)

( * ) Notice: Subject to any disclaimer, the term of this patent is extended or adjusted under 35 U.S.C. 154(b) by 840 days.

(21) Appl. No.: 13/484,777

(22) Filed: May 31, 2012

(65) Prior Publication Data

US 2013/0048017 A1 Feb. 28, 2013

(30) Foreign Application Priority Data

Aug. 25, 2011 (DE) ..... 20 2011 104 832 U

(51) Int. Cl.

| | |
|---|---|
| ***A47L 11/40*** | (2006.01) |
| ***B24D 3/00*** | (2006.01) |
| *B24D 3/02* | (2006.01) |
| *A47L 13/16* | (2006.01) |

(52) U.S. Cl.

CPC ..... *A47L 11/4038* (2013.01); *B24D 3/00* (2013.01); *A47L 13/16* (2013.01); *B24D 3/007* (2013.01); *B24D 3/02* (2013.01)

(58) Field of Classification Search

CPC ... B24D 3/00; B24D 3/07; B24D 3/02; B24D 3/028; A47L 13/16; A47L 11/4038

USPC ..... 451/526, 533, 536, 539

See application file for complete search history.

(56) References Cited

U.S. PATENT DOCUMENTS

| | | | | |
|---|---|---|---|---|
| 2,808,688 | A * | 10/1957 | MacMaster | 451/536 |
| 7,029,747 | B2 * | 4/2006 | Huh et al. | 428/217 |
| 7,763,345 | B2 * | 7/2010 | Chen | B29C 47/0019 428/148 |
| 8,505,150 | B2 * | 8/2013 | Armaly, Jr. | 15/244.3 |
| 2004/0198203 | A1 * | 10/2004 | Kawamura et al. | 451/526 |
| 2006/0005338 | A1 * | 1/2006 | Ashe | A47L 13/16 15/244.4 |
| 2006/0148393 | A1 * | 7/2006 | Ono et al. | 451/526 |
| 2007/0061991 | A1 * | 3/2007 | Gonzales et al. | 15/244.4 |
| 2007/0224901 | A1 * | 9/2007 | Kim | 442/245 |
| 2008/0207101 | A1 * | 8/2008 | Muller | 451/539 |
| 2009/0042480 | A1 * | 2/2009 | Shiro et al. | 451/6 |
| 2009/0093202 | A1 * | 4/2009 | Fukuda et al. | 451/533 |
| 2011/0244769 | A1 * | 10/2011 | David et al. | 451/539 |
| 2015/0004879 | A1 * | 1/2015 | Nakai | 451/41 |

FOREIGN PATENT DOCUMENTS

| | | | | |
|---|---|---|---|---|
| WO | WO 2010093884 | A2 * | 8/2010 | A47L 11/164 |

* cited by examiner

*Primary Examiner* — Michael Jennings

(74) *Attorney, Agent, or Firm* — Laurence A. Greenberg; Werner H. Stemer; Ralph E. Locher

(57) ABSTRACT

An abrasive or cleaning pad includes a composite resin as a wear layer. A cleaning pad system for motorized floor cleaning or polishing applications includes a pad having a combination of two grades of melamine resin-based foam. A method of cleaning a floor surface is also provided.

7 Claims, 2 Drawing Sheets

ABRASIVE OR CLEANING PAD WITH A COMPOSITE RESIN AS A WEAR LAYER, FLOOR CLEANING SYSTEM AND METHOD OF CLEANING A FLOOR SURFACE

CROSS-REFERENCE TO RELATED APPLICATION

This application claims the priority, under 35 U.S.C. §119, of German Utility Model Application DE 20 2011 104 832.6, filed Aug. 25, 2011; the prior application is herewith incorporated by reference in its entirety.

BACKGROUND OF THE INVENTION

Field of the Invention

The invention relates generally to systems and methods for cleaning hard surface floors. More particularly, it relates to melamine composite foam pads for use on motorized floor cleaning machines.

Abrasive pads for the machine cleaning of extensive areas, for use in electrically (mains or battery) operated single-disc machines or scrubber-drier appliances, are made from different materials, in keeping with the nature of the floor and with the cleaning problem to be solved. Thus, it is easily perceivable that the systems employed for carpets will be different than those for mineral and highly-textured tile floors of the kind encountered in large-scale kitchens.

In the case of tiled floor areas of fine stoneware, terracotta, cast stone, etc., which are laid over millions of square meters in supermarkets, shopping malls, offices, schools, hospitals and in industry, it has become established, since about 3-4 years ago, to carry out cleaning with so-called melamine pads, i.e., pads having a melamine resin as their abrasive layer. In principle the melamine resin can only be processed in the form in which it is supplied by the company BASF, as the sole manufacturer. The resin is supplied in two versions, a white version and gray-colored version. Apart from the coloring, both variants are virtually identical, do not differ in structure and hardness and therefore exhibit identical behavior when used as abrasive pads.

Melamine-formaldehyde resin foams, also referred to herein as melamine foams, are well known for use in industrial applications. Those foams have proven effective in heat and sound insulation, fire protection purposes, as well as for automotive and aviation insulation.

Conventional motorized floor cleaning or polishing machines have typically included abrasive floor cleaning pads that are unable to conform to floor surface irregularities. Due to that inability, they cannot adequately clean hard surface floors, especially those with micro porous systems (depressions and/or scratches), which is necessary to achieve an anti-slip category in public and private areas.

It has been found that melamine foams in the form of pads can be connected to floor scrubbing machines to clean hard surfaces as well as to remove soil and stains from hard surfaces.

Melamine foam as such is very soft in its macrostructure and extremely hard in the micro region. The material is therefore ideally suited to providing mechanical support to the cleaning operation, since the hard micro regions enter even into those pores which are smaller than the wavelength of light, and are therefore capable of breaking down the electrostatic interactions between the pore surface and particles of dirt that have become ingrained.

The problems encountered with the existing abrasive pads based on melamine include the mechanism of action of the melamine-based abrasive pads already set forth above. The disadvantageous features of all of the pads on the market include the following:

The areal performance is greatly limited, since the melamine wear layer abrades very quickly.

The abrasive pads based on the melamine foam exhibit a very low tensile strength, and therefore simple unevennesses in the floor or unskilled mounting of the pad on the drive plate cause fractures in the melamine material.

The pads cannot be securely mounted on the existing drive plates, and therefore practically cannot be used, particularly in the case of relatively large scrubber drier machines equipped with drive plates of the kind which lift and lower automatically.

SUMMARY OF THE INVENTION

It is accordingly an object of the invention to provide an abrasive or cleaning pad with a composite resin as a wear layer, a floor cleaning system and a method of cleaning a floor surface, which overcome the hereinafore-mentioned disadvantages of the heretofore-known pads, systems and methods of this general type, which provide a significant improvement over abrasive pads with pure melamine as an abrasive layer and which for the first time make new segments possible that are important in the cleaning of extensive areas.

Most recently, it has been found that combining the two grades of melamine-formaldehyde resin foams in a patchwork fashion in a pad increases durability, increases tear resistance and significantly decreases water intake. All of the disadvantages of melamine described in the previous paragraphs can be overcome with this new system.

With the foregoing and other objects in view there is provided, in accordance with the invention, a cleaning device which is configured for use on a scrubbing machine and includes a melamine composite foam pad and a backing disc connected by a seven-layer, water insoluble glue. The backing disc is constructed to be connected to and retained by a pad driver of the scrubbing machine.

In another preferred embodiment, the melamine composite foam pad and the backing disc are substantially round and the melamine composite foam pad is about 1 inch in thickness.

In an alternative embodiment, the cleaning device includes a substantially round melamine composite foam pad and a substantially round backing disc constructed and disposed to be connected to a pad driver of the scrubbing machine.

In one aspect of the invention, a cleaning apparatus for scrubbing floors comprises a scrubbing machine having a drive device for driving a driving member. A pad driver is connected to the driving member, and a melamine composite foam pad is connected to the pad driver.

In another aspect of the invention, the melamine foam composite pad has a diameter in a range of from 4 to 21 inches.

In another aspect of the invention, the melamine foam composite pad has superior qualities when compared with a regular melamine foam pad, which has one continuous structure. The composite pad incorporates two grades of melamine-formaldehyde resin foams together in a patchwork-like form making the pad more tear resistant, less able to take in water, and longer lasting. The composite pad is also made from recycled materials making it more environmentally sustainable.

In still another aspect of the invention, there is provided a method for cleaning a hard surfaced floor with a floor scrubbing machine having a melamine scrubbing pad. A cleaning agent such as water or a low volatile organic cleaning solution is scrubbed into the floor.

The invention for which protection is sought is based on significant improvements to the abrasive pads which use melamine as their wear layer and which are used for the cleaning of microstructured tiles of extensive areas. The key to the invention lies in the fact that the melamine resin is not used in a block, but instead small resin pieces are compressed and bonded. In physical terms, the effect which applies here is similar to that used in the case, for example, of a carrying cable of a suspension bridge, namely the interweaving of relatively thin cores, since then the carrying load is significantly higher and the breaking strength is increased significantly. In the case of the bonded melamine resin, a fracture is able to extend only to the next point of bonding. Due to the higher level of material used and the greater stiffness of the bonded resin, the wear experienced by the resin during the abrasive operation is significantly lower, and the performances determined by independent users go beyond ten times the areal performance. This also reduces the burden on the environment since the pads of the invention do not need to be discarded as quickly as the prior art pads.

As a further advantage, this stronger composite resin permits milled-out sections in the wear layer, allowing the abrasive pads now to be mounted on the commercial drive plates, and hence also allowing service segments like those of large scrubber-drier machines, which are unattainable by the abrasive pads based on a pure melamine wear layer.

In accordance with another feature of the invention, the resin parts have individual sizes of from 0.5 to 3 $cm^3$ or preferably 1 $cm^3$.

In accordance with a further feature of the invention, the abrasive pad has a diameter of between 10 cm and 70 cm or between 15 cm and 53 cm.

In accordance with an added feature of the invention, the composite resin has a thickness of between 1 cm and 5 cm or between 2 cm and 4 cm.

In accordance with an additional feature of the invention, the backing disc has a central recess formed therein configured with a size of between 2 cm and 10 cm or between 6 cm and 8 cm to ensure a supply of water from a cleaning machine to a floor.

In accordance with yet another feature of the invention, the melamine resin of the wear layer is laminated on one side by a nonwoven configured to transmit a force of a drive plate of a cleaning appliance, and the central recess in the backing disc is extended into another central recess in the wear layer having a size of between 10 cm and 15 cm or between 11 cm and 13 cm and exposing the nonwoven.

In summary, the advantages of the invention for which protection is sought, relative to the conventional abrasive pads with pure melamine as their wear layer, can be listed as follows:

| | Conventional system | System of the invention |
|---|---|---|
| Areal performance per pad (set): | 1000 $m^2$ | Up to 10,000 $m^2$ |
| Tensile strength: | Low | High |
| Capacity for mounting on drive plates: | No | Yes |

Other features which are considered as characteristic for the invention are set forth in the appended claims.

Although the invention is illustrated and described herein as embodied in an abrasive or cleaning pad with a composite resin as a wear layer, a floor cleaning system and a method of cleaning a floor surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
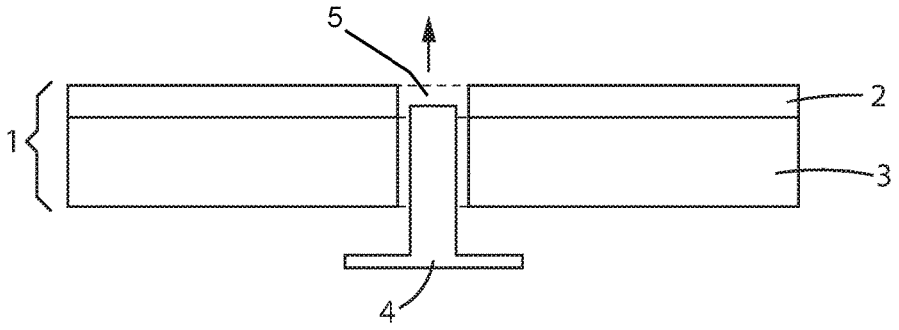
Fig. 1 PRIOR ART
FIG. 1 is a diagrammatic, longitudinal-sectional view of a prior art cleaning pad.

Referring now to the figures of the drawing in detail and first, particularly, to FIG. 1 thereof, there is seen a simplified and diagrammatic illustration of a prior art cleaning pad 1 which includes a backing disc 2 of polyurethane and a scrubbing surface or wear layer 3 of a single component melamine foam/resin, both having a central bore or recess 5 of the same diameter for receiving a fastening element 4. In the operating state, the fastening element 4 fixes the cleaning pad to a non-illustrated pad driver of a cleaning machine as indicated in FIG. 1. By applying pressure, the radially protruding head of the fastening element 4 is pressed into the central region of the scrubbing surface 3 so that the cleaning pad 1 is fixed to the pad driver and the head does not protrude in the axial direction.

Figure 2:
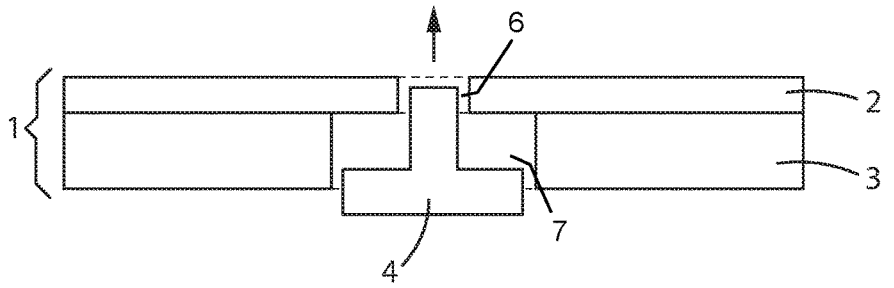
FIG. 2 is a longitudinal-sectional view of a cleaning pad according to the invention.

However, the configuration shown in FIG. 1 would not work well with the new cleaning pads according to the invention due to the low compressibility of the composite melamine resin. Therefore, the geometry of the individual elements has been chosen as indicated in FIG. 2, in which the central bore or recess 5 of the prior art having the same diameter in both the backing disc 2 and the scrubbing surface or wear layer 3 has been replaced by a central bore or recess 6 in the backing disc 2 which is similar in diameter to the central bore or recess 5 as well as a larger-diameter central bore or recess 7 in the scrubbing surface 3 which accommodates the entire width of the fastening element 4. It is noted that details of the fastening element 4, which might include a screw thread or the like, have been omitted in the figure. Similarly, channels or the like for supplying a fluid to the actual scrubbing region can be provided in the cleaning pad 1 and/or in the fastening element 4 and/or between them, but have also been omitted for the sake of clarity.

Figure 3:
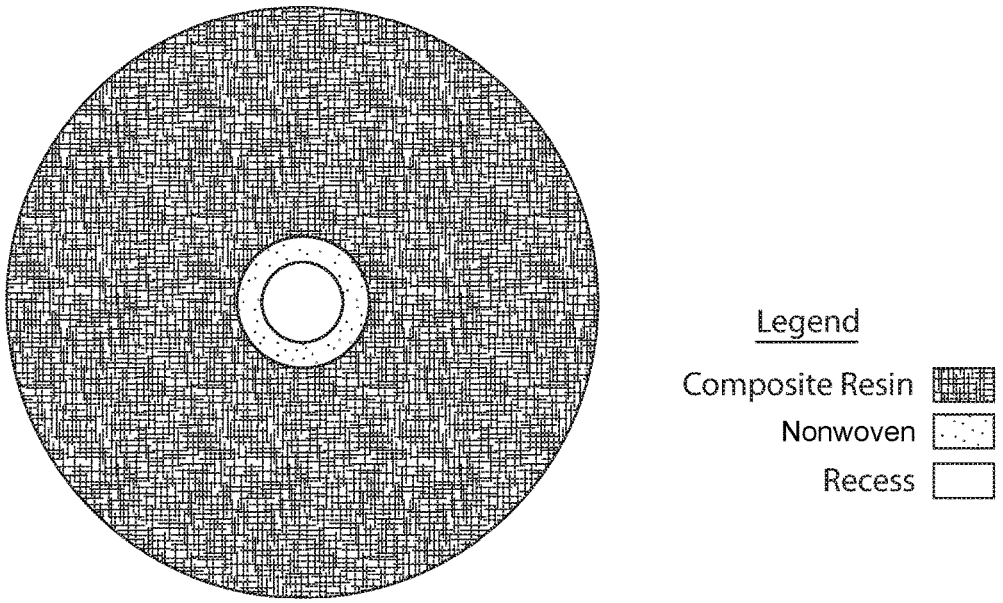
FIG. 3 is a plan view of the cleaning pad according to the invention.

FIG. 3 is a plan view of the cleaning pad 1 according to the invention, which indicates a large outer area formed of a composite resin, an inner area of a nonwoven and a central recess, according to the legend shown in the figure.

Figure 4:
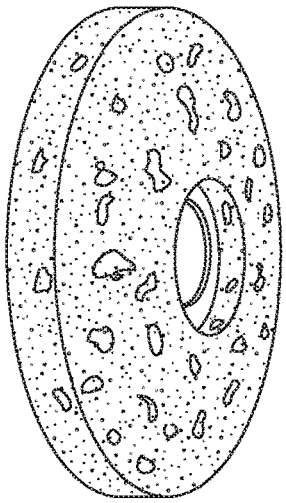
FIGS. 4 and 5 are photographs of a melamine foam composite pad according to the invention.
Figure 5:
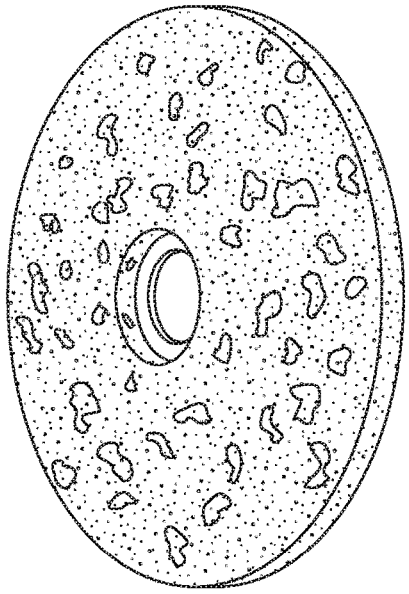

FIGS. 4 and 5 are photographs showing a cleaning pad having the melamine foam composite pad, scrubbing surface or wear layer according to the invention. This cleaning pad is formed of a backing disc and the scrubbing surface, wear layer or composite pad as shown in FIG. 2, adhered together with glue. The backing disc is the site where the pad is connected to the pad driver of the scrubbing machine. The composite pad is composed of melamine-formaldehyde resin foams and is responsible for the cleaning.

The backing disc of the melamine foam composite pad shown in the photographs is approximately ⅛ inch thick, which is a sufficient thickness to ensure connectivity with the pad driver of a motorized floor cleaning machine and avoid additional waste. The melamine composite pad is about 1 inch thick. This thickness allows a composite pad utilized under a scrubbing machine to hold together and efficiently clean up to 10,000 square meters. A traditional melamine pad will wear out after about 1,000 square meters. It is the combination of the two grades of melamine foam that is the key to the durability of the composite pad.

Figure 6:
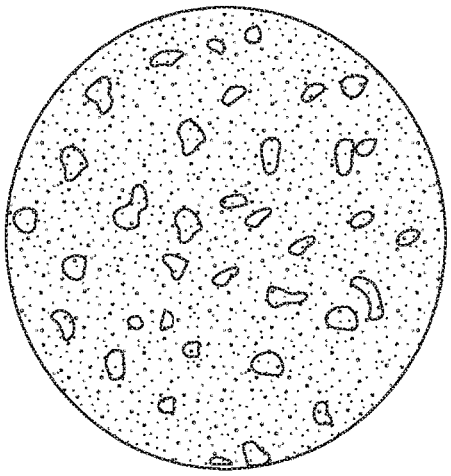
FIG. 6 is a photograph showing two grades of melamine foam intertwined in a single cleaning pad according to the invention, which is not provided with a central recess or bore hole.

FIG. 6 is a photograph showing the cleaning pad before the central recess or bore hole has been provided, from which one can see that the two grades of melamine foam are intertwined in a single cleaning pad. This creates a pad that is dense, stronger and more consistently incapable of absorbing water than a standard melamine pad. Since the pad is formed of many small pieces held together by a seven-layer, water-insoluble glue, the pad is also more tear resistant than any homogenous melamine pad. The cleaning pad may be provided with or without a central borehole or with a borehole plus an additional cutout.

The invention claimed is:

1. An abrasive pad for cleaning microstructured tile surfaces composed of mineral substances, the abrasive pad comprising:

a backing disc having a central recess formed therein configured with a size selected from the group consisting of between 2 cm and 10 cm and between 6 cm and 8 cm to ensure a supply of water from a cleaning machine to a floor;

a wear layer formed of a melamine composite resin including different resin parts bonded with a water-insoluble adhesive, said melamine composite wear layer being a single foam pad having a surface on one side constructed from two grades of melamine-formaldehyde resin foams in a patchwork-type fashion;

said melamine resin of said wear layer being laminated on said one side by a nonwoven configured to transmit a force of a drive plate of a cleaning appliance; and said central recess in said backing disc being extended into another central recess in said wear layer having a size selected from the group consisting of between 10 cm and 15 cm and between 11 cm and 13 cm and exposing said nonwoven.

2. The abrasive pad according to claim 1, wherein said resin parts are melamine resins having white and gray colors.

3. The abrasive pad according to claim 1, wherein said water-insoluble adhesive is a hot melt adhesive.

4. The abrasive pad according to claim 1, wherein said resin parts have individual sizes selected from the group consisting of between 0.5 to 3 cm3 and 1 cm3.

5. The abrasive pad according to claim 1, wherein the abrasive pad has a diameter selected from the group consisting of between 10 cm and 70 cm and between 15 cm and 53 cm.

6. The abrasive pad according to claim 1, wherein said composite resin has a thickness selected from the group consisting of between 1 cm and 5 cm and between 2 cm and 4 cm.

7. The abrasive pad according to claim 1, wherein said melamine resin is laminated on one side by a nonwoven configured to transmit a force of a drive plate of a cleaning appliance.

* * * * *